US009077157B2

(12) United States Patent
Kurono et al.

(10) Patent No.: US 9,077,157 B2
(45) Date of Patent: Jul. 7, 2015

(54) IGNITION PLUG HAVING A REAR TRUNK PORTION THAT PROVIDES SUFFICIENT STRENGTH

(75) Inventors: Hirokazu Kurono, Nagoya (JP); Toshitaka Honda, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/232,101

(22) PCT Filed: Jul. 5, 2012

(86) PCT No.: PCT/JP2012/067184

§ 371 (c)(1),
(2), (4) Date: Jan. 10, 2014

(87) PCT Pub. No.: WO2013/018498

PCT Pub. Date: Feb. 7, 2013

(65) Prior Publication Data

US 2014/0167595 A1 Jun. 19, 2014

(30) Foreign Application Priority Data

Aug. 4, 2011 (JP) ..... 2011-170643

(51) Int. Cl.
*H01T 13/20* (2006.01)
*H01T 13/34* (2006.01)

(52) U.S. Cl.
CPC ..... *H01T 13/20* (2013.01); *H01T 13/34* (2013.01)

(58) Field of Classification Search
CPC ..... H01T 13/20; H01T 13/34; H01T 13/00; H01T 13/02; H01T 13/04; H01T 21/02; F02P 13/00; F02P 15/00
USPC ..... 313/118–145; 123/169 R, 169 EL, 32, 123/41, 310
See application file for complete search history.

(56) References Cited

U.S. PATENT DOCUMENTS 2,478,087 A * 8/1949 Bychinsky et al. ..... 315/57
4,406,968 A 9/1983 Friese et al.

(Continued)

FOREIGN PATENT DOCUMENTS

DE 290304 A 5/1991
EP 0049372 A 4/1982

(Continued)

OTHER PUBLICATIONS

Machine translation of Teramura et al JO 2003-045609 A.*

(Continued)

*Primary Examiner* — Anne Hines
*Assistant Examiner* — Jose M Diaz
(74) *Attorney, Agent, or Firm* — Leason Ellis LLP

(57) ABSTRACT

An ignition plug includes a ceramic insulator having an axial bore, a metallic shell, and a terminal electrode. The terminal electrode has a leg portion inserted into a rear side of the axial bore, and a head portion formed on a rear side of the leg portion and having an outside diameter greater than that of the leg portion. The insulator includes a rear trunk portion exposed from the rear end of the metallic shell, which has a maximum outside diameter of 9.5 mm or less. The insulator has an end-surface seat portion located forward of its rear end and being in contact with the forward end surface of the head portion, and an outer circumferential portion into which at least a forward end portion of the head portion is inserted and which is located externally of the outer circumference of the head portion.

11 Claims, 11 Drawing Sheets

(56) References Cited

U.S. PATENT DOCUMENTS

| | | | | |
|---|---|---|---|---|
| 4,952,837 | A * | 8/1990 | Matsumura et al. | 313/135 |
| 2006/0042610 | A1 | 3/2006 | Abe et al. | |
| 2011/0050069 | A1 | 3/2011 | Raasch | |
| 2012/0169207 | A1 | 7/2012 | Kato | |

FOREIGN PATENT DOCUMENTS

| | | | |
|---|---|---|---|
| JP | 62-64084 | A | 3/1987 |
| JP | 2003-45609 | A | 2/2003 |
| JP | 2006-210142 | A | 8/2006 |
| JP | 2006-100250 | A | 5/2008 |
| WO | WO-2011/033902 | A | 3/2011 |

OTHER PUBLICATIONS

International Search Report mailed Oct. 9, 2012 for the corresponding PCT Application No. PCT/JP2012/067184.

European Search Report mailed Feb. 2, 2015 for the corresponding European Application No. 12819180.6.

* cited by examiner (a)

(b)

(a)

(b)

IGNITION PLUG HAVING A REAR TRUNK PORTION THAT PROVIDES SUFFICIENT STRENGTH

CROSS-REFERENCE TO RELATED PATENT APPLICATIONS

This application is a U.S. National Phase Application under 35 U.S.C. §371 of International Patent Application No. PCT/JP2012/067184, filed Jul. 5, 2012, and claims the benefit of Japanese Patent Application No. 2011-170643, filed on Aug. 4, 2011, all of which are incorporated by reference in their entirety herein. The International Application was published in Japanese on Feb. 7, 2013 as International Publication No. WO/2013/018498 under PCT Article 21(2).

FIELD OF THE INVENTION

The present invention relates to an ignition plug for use in an internal combustion engine or the like.

BACKGROUND OF THE INVENTION

A spark plug for use in a combustion apparatus, such as an internal combustion engine, includes, for example, a tubular insulator having an axial bore, a center electrode provided in an inserted manner at a forward end portion of the axial bore, a terminal electrode provided in an inserted manner at the rear side of the axial bore, and a tubular metallic shell provided externally of an outer circumference of the insulator. The terminal electrode is exposed from the rear end of the insulator and includes a head portion to which a plug cap or the like for supply of electricity is attached, and a rodlike leg portion whose forward end portion is fixed to the insulator by means of a glass seal layer or the like. Furthermore, the insulator includes a rear trunk portion provided at its rear side, exposed from the rear end of the metallic shell, and adapted to ensure electric insulation between the head portion and the metallic shell.

Additionally, the insulator is generally manufactured in the following manner. A material powder which contains alumina, etc., is compacted, yielding a green compact having a hole portion which is to become the axial bore. Next, a support pin is inserted into the hole portion of the green compact; then, a grinding, rotating roller is brought into contact with the outer circumferential surface of the green compact. The rotating roller grinds the green compact, thereby forming an insulator intermediate having substantially the same shape as that of the insulator; then, the insulator intermediate is fired, thereby yielding the insulator (refer to, for example, Japanese Patent Application Laid-Open (kokai) No. 2006-210142).

Incidentally, in some cases, during operation of an internal combustion engine or the like, as a result of oscillation of the head portion of the terminal electrode with a forward end portion of the leg portion fixed to the insulator as a base point, the leg portion of the terminal electrode hits against the inner circumference of the rear trunk portion of the insulator. Hitting of the terminal electrode against the rear trunk portion may cause breakage of the rear trunk portion, or, even when the breakage is not reached, fine cracks may be formed in the rear trunk portion, resulting in deterioration in strength of the rear trunk portion. In view of prevention of breakage of the rear trunk portion and maintenance of strength of the rear trunk portion, increasing the wall thickness of the rear trunk portion for enhancement of strength is effective; however, in recent years, demand has arisen to reduce the size of a spark plug, requiring reduction in the diameter of the insulator.

Thus, in order to achieve prevention of breakage of the rear trunk portion or a like problem while the insulator is reduced in diameter, imparting a relatively small inside diameter to the axial bore is conceived so as to increase the wall thickness (section modulus) of the rear trunk portion (refer to, for example, Japanese Patent Application Laid-Open (kokai) No. 2006-100250).

Problem to be Solved by the Invention

However, imparting a small inside diameter to the axial bore requires impartment of a small diameter to the support pin to be inserted into the hole portion mentioned above, and impartment of a small diameter to the support pin leads to deterioration in strength of the support pin. Thus, in grinding the green compact, load imposed on the green compact from the rotating roller may cause bending of the support pin, and, in turn, dimensional variations may arise among insulator intermediates which have undergone grinding. In view of this, the axial bore must have a certain inside diameter or greater; therefore, for an insulator having a relatively small diameter, there is a limit to increasing its wall thickness for preventing breakage of the rear trunk portion and for maintaining strength of the rear trunk portion.

The present invention has been conceived in view of the above circumstances, and an object of the invention is to provide an ignition plug which can restrain breakage of and deterioration in strength of the rear trunk portion without need to increase the wall thickness of the rear trunk portion while achieving a reduction in diameter of the insulator.

SUMMARY OF THE INVENTION

Means for Solving the Problem

Configurations suitable for achieving the above object will next be described in itemized form. When needed, actions and effects peculiar to the configurations will be described additionally.

Configuration 1. An ignition plug of the present configuration comprises:

an insulator having an axial bore extending in a direction of an axis, a metallic shell disposed externally of an outer circumference of the insulator, and a terminal electrode having a leg portion inserted into a rear side of the axial bore, and a head portion formed on a rear side of the leg portion and having an outside diameter greater than that of the leg portion, and the ignition plug is characterized in that the insulator includes a rear trunk portion exposed from a rear end of the metallic shell, and the rear trunk portion has a maximum outside diameter of 9.5 mm or less, and the insulator has an end-surface seat portion located forward of a rear end of the insulator with respect to the direction of the axis and being in contact with a forward end surface of the head portion, and an outer circumferential portion into which at least a forward end portion of the head portion is inserted and which is located externally of an outer circumference of the head portion.

According to configuration 1 mentioned above, the maximum outside diameter of the rear trunk portion is 9.5 mm or less; thus, there is a concern about breakage of and deterioration in strength of the rear trunk portion caused by vibration.

In this connection, according to configuration 1 mentioned above, the insulator has the outer circumferential portion into which at least a forward end portion of the head portion is inserted and which is located externally of the outer circumference of the head portion. Therefore, when vibration is imposed on the ignition plug as a result of operation of an internal combustion engine or the like, the outer circumferential portion restricts oscillation of the head portion, which is relatively large in outside diameter and, in turn, large in weight and which is located most distant from a forward end portion (vibratory base point) of the terminal electrode (i.e., the head portion where large energy is apt to be generated as a result of oscillation is restricted in oscillation). Accordingly, the amplitude of the head portion becomes small, whereby energy generated by the head portion can be reduced. By virtue of this, there can be reduced the force, derived from the energy generated by the head portion, that the terminal electrode (leg portion) applies to the rear trunk portion. As a result, without need to increase the wall thickness of the rear trunk portion, there can be reliably prevented breakage of and deterioration in strength of the rear trunk portion which could otherwise result from impact of the terminal electrode.

Configuration 2. An ignition plug of the present configuration is characterized in that, in configuration 1 mentioned above, a relational expression $L1 \geq 0.5$ is satisfied, where L1 (mm) is a distance along the axis from a rear end of the outer circumferential portion to the end-surface seat portion.

Notably, in the case where the end-surface seat portion is inclined with respect to a direction orthogonal to the axis, the "distance L1" is a distance along the axis from the rear end of the outer circumferential portion to the rearmost end of the end-surface seat portion.

According to configuration 2 mentioned above, the outer circumferential portion can effectively restrict oscillation of the head portion. As a result, breakage of and deterioration in strength of the rear trunk portion can be further reliably prevented.

Configuration 3. An ignition plug of the present configuration is characterized in that, in configuration 1 or 2 mentioned above, a relational expression $L1/L2 \geq 1/3$ is satisfied, where L1 (mm) is a distance along the axis from a rear end of the outer circumferential portion to the end-surface seat portion, and L2 (mm) is a length of the head portion along the axis.

Notably, in the case where the forward end surface of the head portion is inclined with respect to a direction orthogonal to the axis, the "length L2" is a length along the axis from the rearmost end portion of the forward end surface to the rear end of the head portion.

According to configuration 3 mentioned above, the outer circumferential portion restricts oscillation of that portion of the head portion which is located further rearward with respect to the direction of the axis (a portion located further distant from the vibratory base point). Therefore, the amplitude of the head portion can be further reduced, whereby breakage of the rear trunk portion or a like problem can be more effectively prevented.

Configuration 4. An ignition plug of the present configuration is characterized in that, in any one of configurations 1 to 3 mentioned above, relational expressions $L2 \leq 3.5$ and $L1 \geq 0.8$ are satisfied, where L1 (mm) is a distance along the axis from a rear end of the outer circumferential portion to the end-surface seat portion, and L2 (mm) is a length of the head portion along the axis.

In recent years, in order to ensure good ignition performance, voltage applied to the ignition plug (terminal electrode) has been increasing; accordingly, there is greater concern about occurrence of abnormal discharge (so-called flashover) between the head portion and the metallic shell along the outer circumferential surface of the rear trunk portion. In view of restraint of occurrence of flashover, increasing the length of the rear trunk portion along the axis is effective; however, since, in view of conformity to standards, etc., the overall length of the ignition plug cannot be changed, increasing the length of the rear trunk portion requires reduction in the length of the head portion along the axis. However, reducing the length of the head portion leads to reduction in contact area between the head portion and a fitting member to be fitted to the outer circumference of the head portion when a plug cap or the like for supply of electricity and the terminal electrode are connected together. As a result, vibration imposed on the terminal electrode as a result of operation of an internal combustion engine or the like increases; accordingly, breakage of and deterioration in strength of the rear trunk portion are of further concern. That is, the smaller the length of the head portion, the more likely the occurrence of breakage of the rear trunk portion or a like problem. In place of the fitting member, for example, a spring may be used for electrical connection between the plug cap or the like and the terminal electrode; even in this case, similarly, the smaller the length of the head portion, the more likely the occurrence of breakage of the rear trunk portion or a like problem.

In this connection, according to configuration 4, the length L2 of the head portion is 3.5 mm or less; therefore, while occurrence of flashover can be restrained, breakage of the rear trunk portion or a like problem is of concern. However, according to configuration 4, the distance L1 is 0.8 mm or more; therefore, the outer circumferential portion can further reliably restrict oscillation of the head portion. Thus, even when breakage of the rear trunk portion or a like problem is of further concern, breakage of the rear trunk portion or a like problem can be very effectively prevented.

Configuration 5. An ignition plug of the present configuration is characterized in that, in any one of configurations 1 to 4 mentioned above, the insulator has a leg-portion insertion portion into which the leg portion is inserted;

the insulator has a curved portion convexly curved toward the axis and formed between the leg-portion insertion portion and the end-surface seat portion; and a relational expression $R1 \geq 0.1$ is satisfied, where R1 (mm) is a radius of curvature of an outline of the curved portion in a section which contains the axis.

Notably, in the case where the radius of curvature of the outline of the curved portion is not fixed, the "radius of curvature R1" is the radius of curvature of an imaginary circle which, in a section which contains the axis, passes through a forwardmost point on the outline of the curved portion with respect to the direction of the axis, a rearmost point on the outline with respect to the direction of the axis, and a midpoint on the outline between the two points.

According to configuration 5 mentioned above, the curved portion convexly curved toward the axis is provided between the leg-portion insertion portion and the end-surface seat portion. Therefore, in inserting the terminal electrode into the insulator, the curved portion guides the leg portion, so that the axis and the center axis of the terminal electrode can accurately coincide with each other. Thus, the gap between the outer circumferential portion and the head portion can be substantially uniform along the circumferential direction. By virtue of this, even when the terminal electrode oscillates in any radial direction along the circumferential direction, the amplitude of the head portion can be restrained within a relatively small range; as a result, breakage of the rear trunk portion or a like problem can be further reliably prevented.

In the case where the gap between the leg-portion insertion portion and the leg portion is narrowed at a certain circumferential location, the leg portion is likely to come into contact with the insulator at the gap-narrowed location with vibration; however, according to configuration 5 mentioned above, the gap between the leg-portion insertion portion and the leg portion can be substantially uniform along the circumferential direction. Therefore, contact of the leg portion with the insulator can be restrained, whereby the effect of preventing breakage of the rear trunk portion or a like problem can be further improved.

Notably, when the radius of curvature R1 is excessively increased, the forward end surface of the head portion comes into contact with the curved portion, potentially resulting in positional deviation of the head portion with respect to the direction of the axis. Therefore, in view of restraint of positional deviation of the head portion, preferably, the radius of curvature R1 is 3.0 mm or less.

Configuration 6. An ignition plug of the present configuration is characterized in that, in any one of configurations 1 to 5 mentioned above, a relational expression $0.5 \leq L3 \leq 2.0$ is satisfied, where L3 (mm) is a width of the end-surface seat portion along a direction orthogonal to the axis.

Notably, the "width L3" can be said to be half of the difference between the inside diameter of the end-surface seat portion and the outside diameter of the end-surface seat portion.

According to configuration 6 mentioned above, the width L3 is 0.5 mm or more, so that the end-surface seat portion can have a sufficiently large area. Therefore, the forward end surface of the head portion more reliably comes into contact with the end-surface seat portion, whereby there can be prevented the situation in which a portion of the forward end surface fails to come into contact with the end-surface seat portion, resulting in forward penetration of the head portion beyond the end-surface seat portion. As a result, positional deviation of the head portion can be more reliably prevented.

Additionally, according to configuration 6 mentioned above, the width L3 is 2.0 mm or less, so that a sufficient wall thickness can be ensured for the outer circumferential portion located radially outward of the end-surface seat portion. Thus, there can be effectively prevented chipping or a like defect of the outer circumferential portion which could otherwise result from contact of the head portion.

Configuration 7. An ignition plug of the present configuration is characterized in that, in any one of configurations 1 to 6 mentioned above, in a section which contains the axis, an outline of the end-surface seat portion extends along a direction orthogonal to the axis.

Notably, the expression "an outline of the end-surface seat portion extends along a direction orthogonal to the axis" encompasses not only a case where the outline of the end-surface seat portion extends strictly along a direction orthogonal to the axis, but also a case where the outline of the end-surface seat portion is inclined slightly (e.g., by 5° or less) with respect to a direction orthogonal to the axis.

According to configuration 7 mentioned above, a situation in which the center axis of the terminal electrode inclines with respect to the axis becomes unlikely to arise. Therefore, positioning of the head portion can be done more properly.

Configuration 8. An ignition plug of the present configuration is characterized in that, in any one of configurations 1 to 7 mentioned above, a shortest distance along a direction orthogonal to the axis between an inner circumferential surface of the outer circumferential portion and an outer circumferential surface of that portion of the head portion which is inserted into the outer circumferential portion is smaller than a shortest distance along the direction orthogonal to the axis between an outer circumferential surface of the leg portion and an inner circumferential surface of the axial bore.

According to configuration 8 mentioned above, during operation of an internal combustion engine or the like, contact of the leg portion with the insulator is restrained, so that the outer circumferential portion further reliably restricts oscillation of the head portion. As a result, actions and effects of the configurations 1, etc. mentioned above are more reliably exhibited.

Configuration 9. An ignition plug of the present configuration is characterized in that, in any one of configurations 1 to 8 mentioned above, the outer circumferential portion has a diameter-reducing portion whose inside diameter reduces forward with respect to the direction of the axis.

According to configuration 9 mentioned above, the outer circumferential portion has the diameter-reducing portion whose inside diameter reduces forward with respect to the direction of the axis. Thus, in insertion of the terminal electrode into the axial bore or in a like operation, through contact of the head portion with the diameter-reducing portion, the center axis of the terminal electrode can further accurately coincide with the axis. Therefore, the gap between the outer circumferential surface of the terminal electrode and the inner circumferential surface of the insulator can be substantially uniform along the circumferential direction. By virtue of this, the amplitude of the head portion can be restrained within a smaller range, and contact of the leg portion with the rear trunk portion can be restrained; as a result, the effect of preventing breakage of the rear trunk portion or a like problem can be further improved.

Configuration 10. An ignition plug of the present configuration is characterized in that, in any one of configurations 1 to 9 mentioned above, that portion of the head portion which is inserted into the outer circumferential portion has a diameter-increasing portion whose outside diameter increases rearward with respect to the direction of the axis.

According to configuration 10 mentioned above, that portion of the head portion which is inserted into the outer circumferential portion has the diameter-increasing portion whose diameter increases rearward with respect to the direction of the axis. Therefore, in insertion of the terminal electrode into the axial bore or in a like operation, the center axis of the terminal electrode can further accurately coincide with the axis. As a result, the effect of preventing breakage of the rear trunk portion or a like problem can be further enhanced.

Configuration 11. An ignition plug of the present configuration is characterized in that, in any one of configurations 1 to 10 mentioned above, the rear trunk portion has an annular groove portion formed on its outer circumference and extending along its circumferential direction, and a relational expression $L4 \geq 0.5$ is satisfied, where L4 (mm) is a distance along the axis from the end-surface seat portion to a bottom of the groove portion.

Notably, in the case where the end-surface seat portion is inclined with respect to a direction orthogonal to the axis, "distance L4" is a distance along the axis from the rear end of the end-surface seat portion to the bottom of the groove portion.

According to configuration 11 mentioned above, the rear trunk portion has the groove portion, so that the distance between the head portion and the rear end of the metallic shell as measured along the outer circumferential surface of the rear trunk portion can be increased. Therefore, there can be restrained occurrence of abnormal discharge (flashover) between the head portion and the metallic shell along the outer circumferential surface of the rear trunk portion.

Meanwhile, that portion of the rear trunk portion where the groove portion is formed is relatively thin-walled and is thus inferior in strength to the other portion. Therefore, when stress generated at the root of the outer circumferential portion (a boundary portion between the outer circumferential portion and the end-surface seat portion) as a result of contact of the head portion with the outer circumferential portion is applied to the thin-walled portion, breakage such as cracking may occur at the thin-walled portion.

In view of this, according to configuration 11 mentioned above, the distance L4 along the axis from the end-surface seat portion to the bottom of the groove portion (i.e., a thin-walled portion of the rear trunk portion) is 0.5 mm or more. That is, a sufficiently large distance is provided between a location of generation of stress and the thin-walled portion. Therefore, stress can be less likely to be applied to the thin-walled portion, so that breakage of the thin-walled portion can be more reliably prevented.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
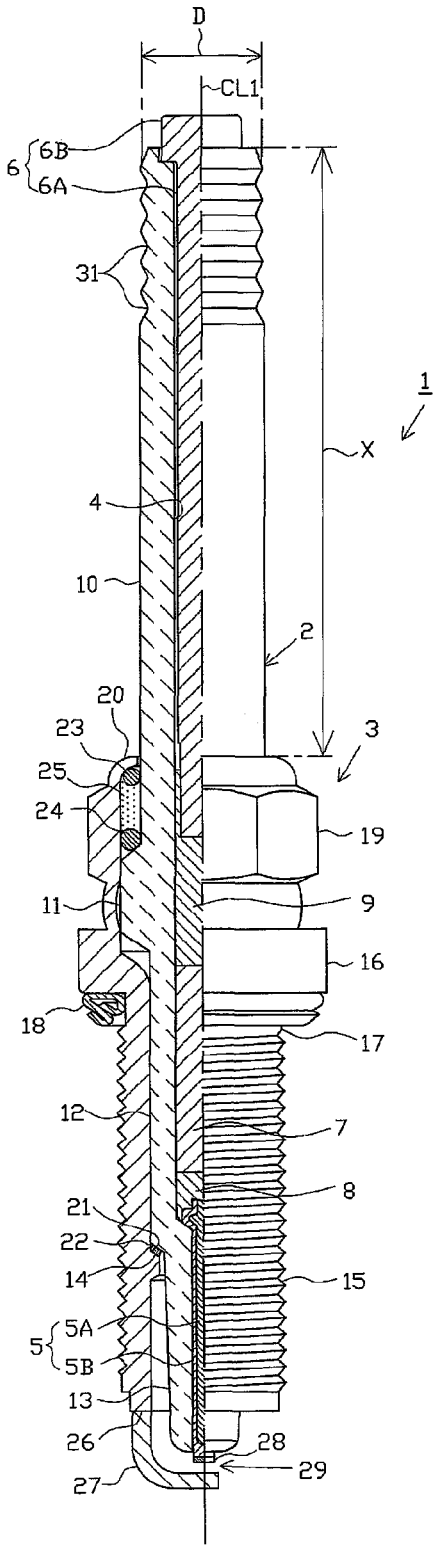
FIG. 1 is a partially cutaway front view showing the configuration of an ignition plug.

An embodiment of the present invention will next be described with reference to the drawings. FIG. 1 is a partially cutaway front view showing an ignition plug 1. In FIG. 1, the direction of an axis CL1 of the ignition plug 1 is referred to as the vertical direction. In the following description, the lower side of the spark plug 1 in FIG. 1 is referred to as the forward side of the spark plug 1, and the upper side as the rear side.

The ignition plug 1 includes a tubular ceramic insulator 2 and a tubular metallic shell 3, which holds the ceramic insulator 2 therein.

The ceramic insulator 2 is formed from alumina or the like by firing, as well known in the art. The ceramic insulator 2, as viewed externally, includes a rear trunk portion 10 formed at its rear side; a large-diameter portion 11 located forward of the rear trunk portion 10 and projecting radially outward; an intermediate trunk portion 12 located forward of the large-diameter portion 11 and being smaller in diameter than the large-diameter portion 11; and a leg portion 13 located forward of the intermediate trunk portion 12 and being smaller in diameter than the intermediate trunk portion 12. While the large-diameter portion 11, the intermediate trunk portion 12, and most of the leg portion 13 of the ceramic insulator 2 are accommodated within the metallic shell 3, the rear trunk portion 10 is exposed from the rear end of the metallic shell 3. A stepped portion 14 tapered forward is formed at a connection portion between the intermediate trunk portion 12 and the leg portion 13. The ceramic insulator 2 is seated on the metallic shell 3 at the stepped portion 14.

Furthermore, the rear trunk portion 10 has a plurality of annular groove portions 31 extending along its circumferential direction and formed intermittently along the direction of the axis CL1. Additionally, in the present embodiment, a distance X along the axis CL1 from the rear end of the ceramic insulator 2 to the rear end of the metallic shell 3 is relatively large (e.g., 30 mm or more). By means of provision of the groove portions 31 and employment of a relatively large distance X, there can be enhanced electric insulation between a head portion 6B of a terminal electrode 6, which will be described later, and the rear end of the metallic shell 3, and, in turn, there can be effectively restrained occurrence of abnormal discharge (flashover) between the head portion 6B and the metallic shell 3 along the outer circumferential surface of the rear trunk portion 10.

Additionally, in order to reduce the diameter of the spark plug 1, a relatively small diameter is imparted to the ceramic insulator 2; specifically, the rear trunk portion 10 has a maximum outside diameter D of 9.5 mm or less. Meanwhile, a certain magnitude (e.g., 3 mm or more) is ensured for the minimum inside diameter of the axial bore 4 in the rear trunk portion 10; as a result, the wall thickness of the rear trunk portion 10 is relatively small.

Furthermore, the ceramic insulator 2 has an axial bore 4 extending therethrough along the axis CL1. A center electrode 5 is fixedly inserted into a forward end portion of the axial bore 4. The center electrode 5 includes an inner layer 5A formed of a metal having excellent thermal conductivity [e.g., copper, a copper alloy, or pure nickel (Ni)], and an outer layer 5B formed of a nickel alloy which contains nickel as a main component. Furthermore, the center electrode 5 assumes a rodlike (circular columnar) shape as a whole, and its forward end portion protrudes from the forward end of the ceramic insulator 2. Additionally, a tip 28 formed of a metal having excellent resistance to erosion (e.g., an iridium alloy or a platinum alloy) is provided at a forward end portion of the center electrode 5.

Also, a solid terminal electrode 6 having a circular cross section is fixedly inserted into the rear side of the axial bore 4. The terminal electrode 6 is formed of a low-carbon steel or a like metal and includes a leg portion 6A and the head portion 6B.

The leg portion 6A has a rodlike shape extending along the direction of the axis CL1 and is entirely inserted into the axial bore 4. Also, since the distance X is large as mentioned above, the leg portion 6A has a relatively large length (e.g., 40 mm to 50 mm) along the direction of the axis CL1.

The head portion 6B has a circular columnar shape, is formed rearward of the leg portion 6A, and is greater in outside diameter than the leg portion 6A. Furthermore, the length of the head portion 6B along the axis CL1 is relatively small (e.g., 3 mm to 5 mm). In the present embodiment, the head portion 6B has a substantially fixed outside diameter along the direction of the axis CL1, and a portion of the head portion 6B protrudes rearward with respect to the direction of the axis CL1 from the rear end of the ceramic insulator 2.

Additionally, a circular columnar, electrically conductive resistor 7 is disposed within the axial bore 4 between the center electrode 5 and the terminal electrode 6. Also, electrically conductive glass seal layers 8 and 9 are provided on opposite sides, respectively, of the resistor 7; the glass seal layer 8 fixes the center electrode 5 to the ceramic insulator 2; and the glass seal layer 9 fixes a forward end portion of the terminal electrode 6 to the ceramic insulator 2.

Furthermore, the metallic shell 3 is formed into a tubular shape from a low-carbon steel or a like metal. The metallic shell 3 has, on its outer circumferential surface, a threaded portion (externally threaded portion) 15 adapted to mount the ignition plug 1 into a mounting hole of a combustion apparatus (e.g., an internal combustion engine or a fuel cell reformer). Also, the metallic shell 3 has, on its outer circumferential surface, a seat portion 16 located rearward of the threaded portion 15 and protruding radially outward. A ring-like gasket 18 is fitted to a screw neck 17 at the rear end of the threaded portion 15. Furthermore, the metallic shell 3 has, near the rear end thereof, a tool engagement portion 19 having a hexagonal cross section and allowing a tool, such as a wrench, to be engaged therewith when the metallic shell 3 is to be mounted to the combustion apparatus. Also, the metallic shell 3 has a crimped portion 20 provided at a rear end portion thereof for holding the ceramic insulator 2.

Also, the metallic shell 3 has, on its inner circumferential surface, a tapered, stepped portion 21 adapted to allow the ceramic insulator 2 to be seated thereon. The ceramic insulator 2 is inserted forward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimped portion 20 is formed, whereby the ceramic insulator 2 is fixed to the metallic shell 3. An annular sheet packing 22 intervenes between the stepped portions 14 and 21 of the ceramic insulator 2 and the metallic shell 3, respectively. This retains airtightness of a combustion chamber and prevents outward leakage of fuel gas entering a clearance between the leg portion 13 of the ceramic insulator 2 and the inner circumferential surface of the metallic shell 3, the clearance being exposed to the combustion chamber.

Furthermore, in order to ensure airtightness which is established by crimping, annular ring members 23 and 24 intervene between the metallic shell 3 and the ceramic insulator 2 in a region near the rear end of the metallic shell 3, and a space between the ring members 23 and 24 is filled with a powder of talc 25. That is, the metallic shell 3 holds the ceramic insulator 2 via the sheet packing 22, the ring members 23 and 24, and the talc 25.

A ground electrode 27 is joined to a forward end portion 26 of the metallic shell 3 and is bent at its substantially intermediate portion such that a side surface of its distal end portion faces a forward end portion (tip 28) of the center electrode 5. The ground electrode 27 is formed of an Ni alloy [e.g., INCONEL 600 or INCONEL 601 (registered trademark)], and a spark discharge gap 29 is formed between the distal end portion of the ground electrode 27 and the forward end portion (tip 28) of the center electrode 5. Spark discharges are performed across the spark discharge gap 29 substantially along the axis CL1.

Next, the configuration of that portion of the ceramic insulator 2 into which the terminal electrode 6 is inserted will be described.

Figure 2:
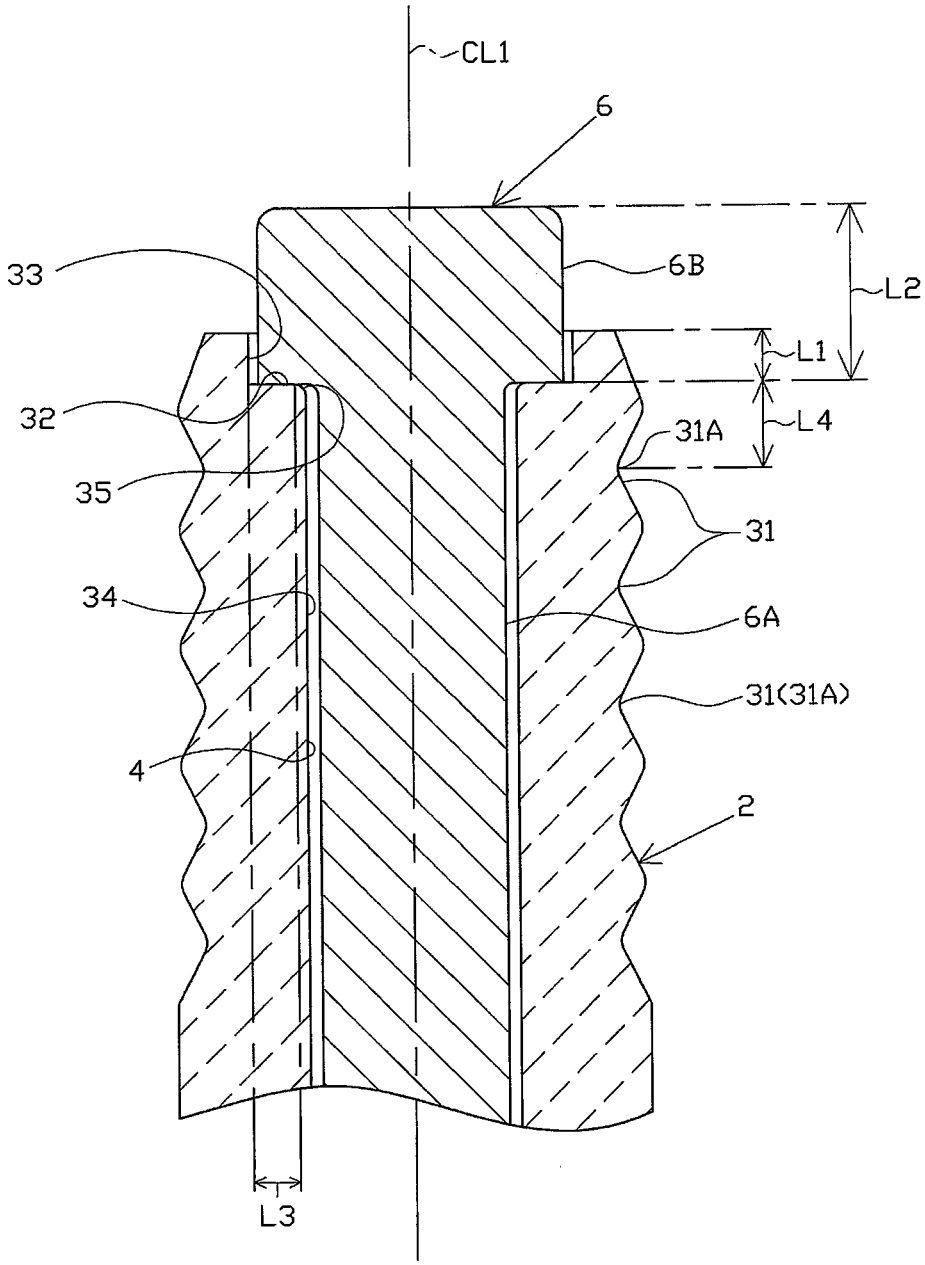
FIG. 2 is an enlarged sectional view showing the configuration of a rear end portion of the ignition plug.

As shown in FIG. 2, the ceramic insulator 2 includes an end-surface seat portion 32 located forward of its rear end with respect to the direction of the axis CL1 and being in contact with a forward end surface of the head portion 6B, and an outer circumferential portion 33 into which at least a forward end portion of the head portion 6B is inserted and which is located externally of the outer circumference of the head portion 6B. The ceramic insulator 2 also includes a leg-portion insertion portion 34 which is located forward of the end-surface seat portion 32 with respected to the direction of the axis CL1 and into which the leg portion 6A is inserted.

In a section which contains the axis CL1, the outline of the end-surface seat portion 32 extends in a direction orthogonal to the axis CL1, and the end-surface seat portion 32 excluding its outer circumferential portion is in contact with the forward end surface of the head portion 6B. Also, the end-surface seat portion 32 is configured such that the relational expression $0.5 \leq L3 \leq 2.0$ is satisfied, where L3 (mm) is the width of the end-surface seat portion 32 along a direction orthogonal to the axis CL1. That is, the area of the surface where the head portion 6B is seated is not excessively small, whereas a sufficient wall thickness is ensured for the outer circumferential portion 33 which extends rearward with respect to the direction of the axis CL1 from the outer circumference of the end-surface seat portion 32.

Also, the relational expression $L4 \geq 0.5$ is satisfied, where L4 (mm) is the distance along the axis CL1 from the end-surface seat portion 32 to a bottom 31A of the groove portion 31. That is, the relative position between the groove portion 31 and the end-surface seat portion 32 is determined such that the bottom 31A of the groove 31 (i.e., that portion of the rear trunk portion 10 where wall thickness is thin) is located 0.5 mm or more away from the end-surface seat portion 32 (the root of the outer circumferential portion 33) along the direction of the axis CL1.

The outer circumferential portion 33 is configured to be annular and such that its inside diameter is substantially fixed along the axis CL1. Also, a gap of a predetermined value (e.g., 1 mm) or less along a direction orthogonal to the axis CL1 is established between the inner circumferential surface of the outer circumferential portion 33 and the outer circumferential surface of the head portion 6B. Furthermore, the outer circumferential portion 33 is configured such that the relational expression $L1 \geq 0.5$ is satisfied, where L1 (mm) is the distance along the axis CL1 from the rear end of the outer circumferential portion 33 to the end-surface seat portion 32. Additionally, the outer circumferential portion 33 is configured such that the relational expression $L1/L2 \geq 1/3$ is satisfied, where L2 (mm) is the length of the head portion 6B along the axis CL1; i.e., such that the length of the outer circumferential surface 33 is sufficiently large as compared with the length L2 of the head portion 6B. In the case where the relational expression $L2 \leq 3.5$ is satisfied, preferably, the relational expression $L1 \geq 0.8$ is satisfied. Also, in the present embodiment, the distance L1 is determined so as to satisfy the relational expression $L1/L2 \leq 1$.

Figure 3:
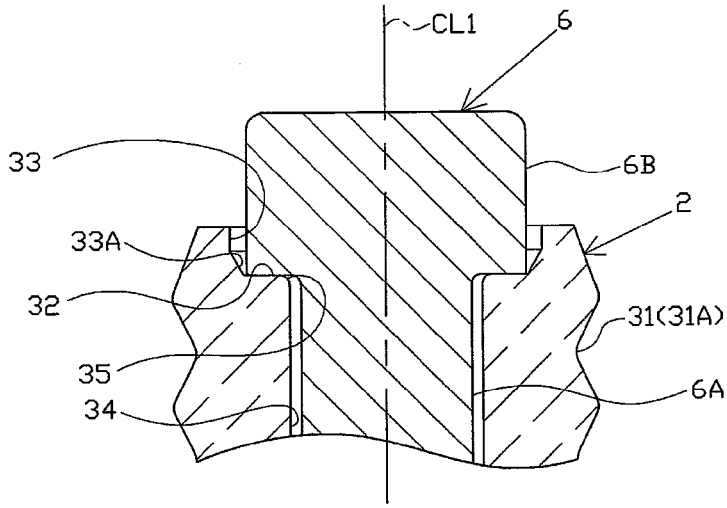
FIG. 3 is a set of enlarged sectional views consisting of views (a) and (b) and showing other examples of an outer circumferential portion.
Figure 3:
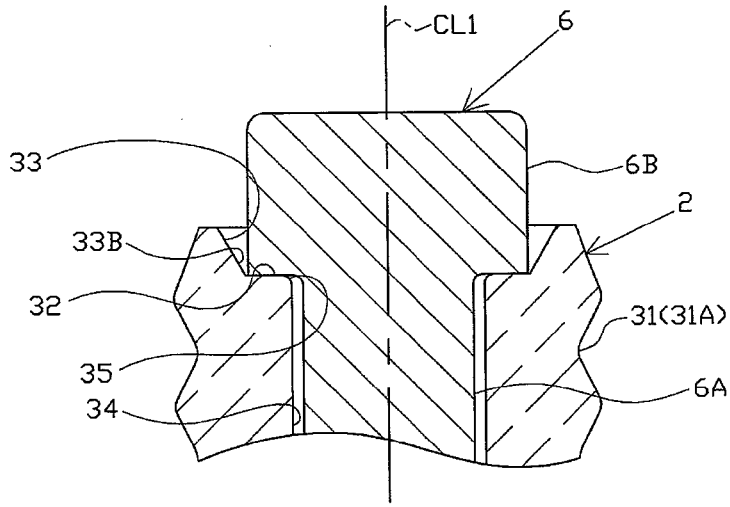

As shown in FIGS. 3(*a*) and 3(*b*), instead of the inside diameter of the outer circumferential portion 33 being substantially fixed along the direction of the axis CL1, the outer circumferential portion 33 may have a diameter-reducing portion 33A or 33B whose inside diameter reduces forward with respect to the direction of the axis CL1. The diameter-reducing portions 33A and 33B may be provided as follows: as shown in FIG. 3(*a*), the diameter-reducing portion 33A is provided partially at the outer circumferential portion 33, or, as shown in FIG. 3(*b*), the diameter-reducing portion 33B is provided along the entire range of the outer circumferential portion 33. In the case where, as shown in FIG. 3(*b*), the diameter-reducing portion 33B is provided at the inner circumferential rear end of the outer circumferential portion 33, even when, in insertion of the terminal electrode 6 into the ceramic insulator 2, the terminal electrode 6 is deviated to a certain extent from the axial bore 4, the terminal electrode 6 is guided into the axial bore 4 in such a manner as to slide on the diameter-reducing portion 33B. Therefore, there can be more reliably prevented a situation in which, as a result of contact of a forward end portion of the terminal electrode 6 with the rear end of the ceramic insulator 2, a large pressure is applied to the ceramic insulator 2, causing chipping of the ceramic insulator 2.

Figure 4:
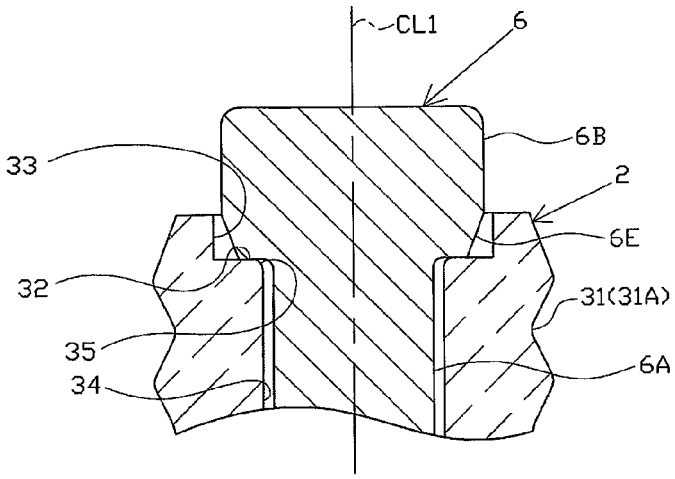
FIG. 4 is a set of enlarged sectional views consisting of views (a) and (b) and showing other examples of a head portion.
Figure 4:
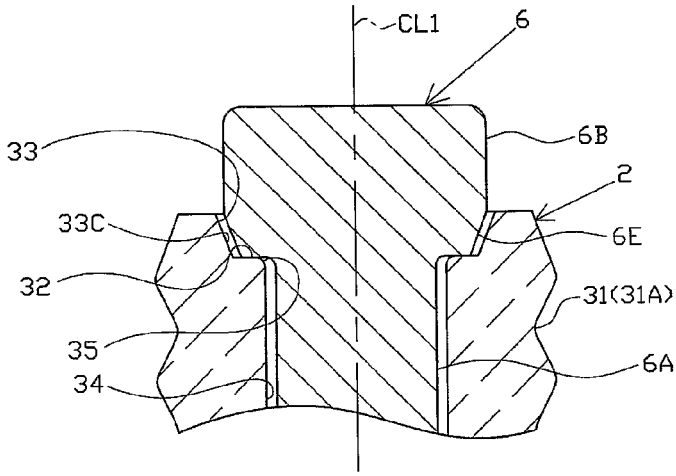

Also, as shown in FIGS. 4(*a*) and 4(*b*), the head portion 6B may have a diameter-increasing portion 6E whose outside diameter increases rearward with respect to the direction of the axis CL1, at at least a portion to be inserted into the outer circumferential portion 33. The diameter-increasing portion 6E may be provided as follows: as shown in FIG. 4(*a*), the inside diameter of the outer circumferential portion 33 is substantially fixed along the direction of the axis CL1, or, as shown in FIG. 4(*b*), the outer circumferential portion 33 has a diameter-reducing portion 33C whose diameter reduces forward with respect to the direction of the axis CL1.

Referring back to FIG. 2, the leg-portion insertion portion 34 has an inside diameter which is substantially fixed along the axis CL1, and a gap is formed between its inner circumferential surface and the outer circumferential surface of the leg portion 6A. Meanwhile, the shortest distance along a direction orthogonal to the axis CL1 between the inner circumferential surface of the outer circumferential portion 33 and the outer circumferential surface of that portion of the head portion 6B which is inserted into the outer circumferential portion 33 is rendered smaller than the shortest distance along the direction orthogonal to the axis CL1 between the outer circumferential surface of the leg portion 6A and the inner circumferential surface of the leg-portion insertion portion 34 (axial bore 4). Therefore, when the terminal electrode 6 oscillates as a result of vibration during operation of an internal combustion engine or the like, the head portion 6B is more likely to come into contact with the ceramic insulator 2 than is the leg portion 6A.

Figure 5:
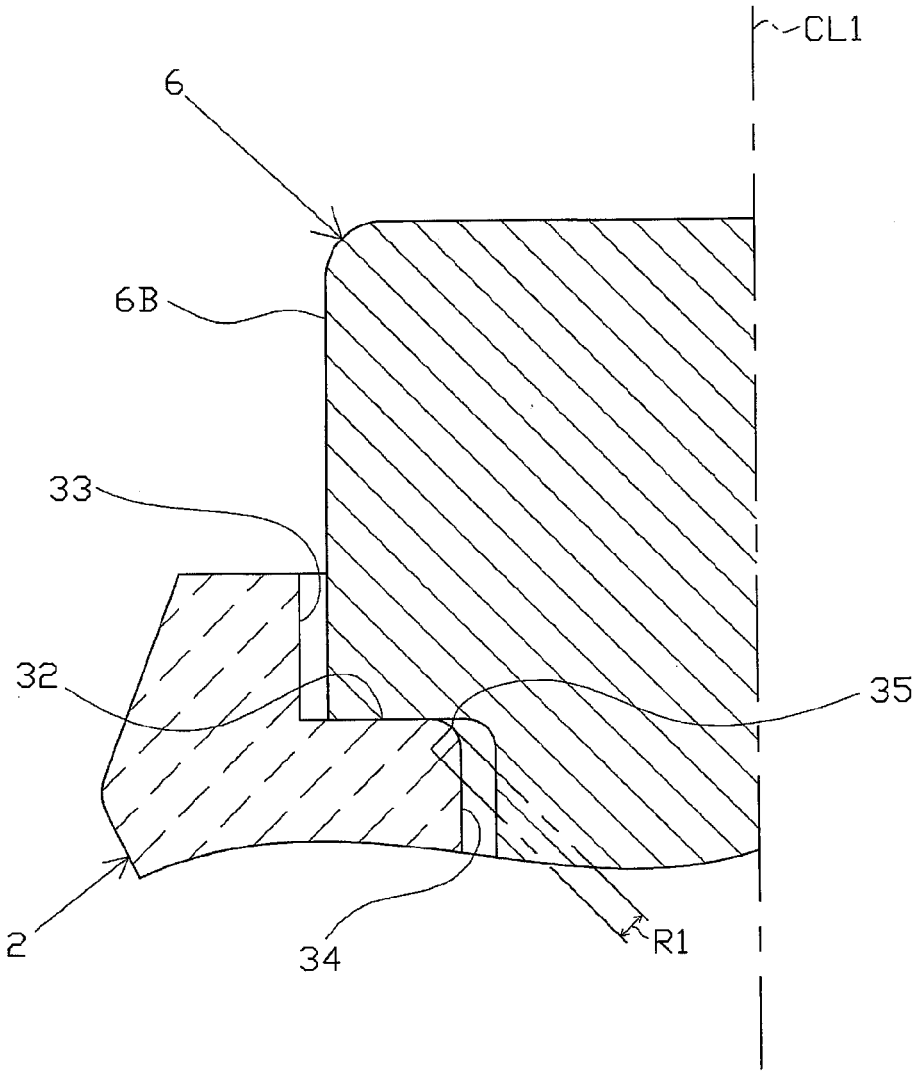
FIG. 5 is a fragmentary, enlarged sectional view for explaining the radius of curvature of a curved portion.

Additionally, in the present embodiment, a curved portion 35 convexly curved toward the axis CL1 is provided between the end-surface seat portion 32 and the leg-portion insertion portion 34. As shown in FIG. 5, the curved portion 35 is configured such that, in a section which contains the axis CL1, the relational expression $R1 \geq 0.1$ is satisfied, where R1 (mm) is the radius of curvature of the outline of the curved portion 35. If the radius of curvature R1 is excessively increased, the forward end surface of the head portion 6B will come into contact with the curved portion 35, potentially resulting in occurrence of positional deviation of the terminal electrode 6 (head portion 6B) along the axis CL1. Therefore, preferably, the curved portion 35 is configured to satisfy the relational expression $R1 \leq 3.0$.

Next, a method of manufacturing the thus-configured ignition plug 1 will be described.

First, the metallic shell 3 is formed beforehand. Specifically, a circular columnar metal material (e.g., an iron-based material such as S17C or S25C, or a stainless steel material) is subjected to cold forging, etc., so as to form a through hole and a general shape. Subsequently, machining is conducted so as to adjust the external shape, thereby yielding a metallic-shell intermediate.

Then, the ground electrode 27 formed of an Ni alloy or a like metal is resistance-welded to the forward end surface of the metallic-shell intermediate. The resistance welding is accompanied by formation of so-called "sags." After the "sags" are removed, the threaded portion 15 is formed in a predetermined region of the metallic-shell intermediate by rolling. Thus, the metallic shell 3 to which the ground electrode 27 is welded is obtained. The metallic shell 3 to which the ground electrode 27 is welded is subjected to galvanization or nickel plating. In order to enhance corrosion resistance, the plated surface may be further subjected to chromate treatment.

Furthermore, separately from preparation of the metallic shell 3, the center electrode 5 is formed. Specifically, an Ni alloy in which a copper alloy or a like metal is disposed in a central region for improving heat radiation performance is subjected to forging, thereby yielding the center electrode 5. Next, the tip 28 is joined to the forward end surface of the center electrode 5 by laser welding or the like.

Also, the terminal electrode 6 is manufactured beforehand from an electrically conductive metal such as a low-carbon steel by forging, cutting, etc.

Figure 6:
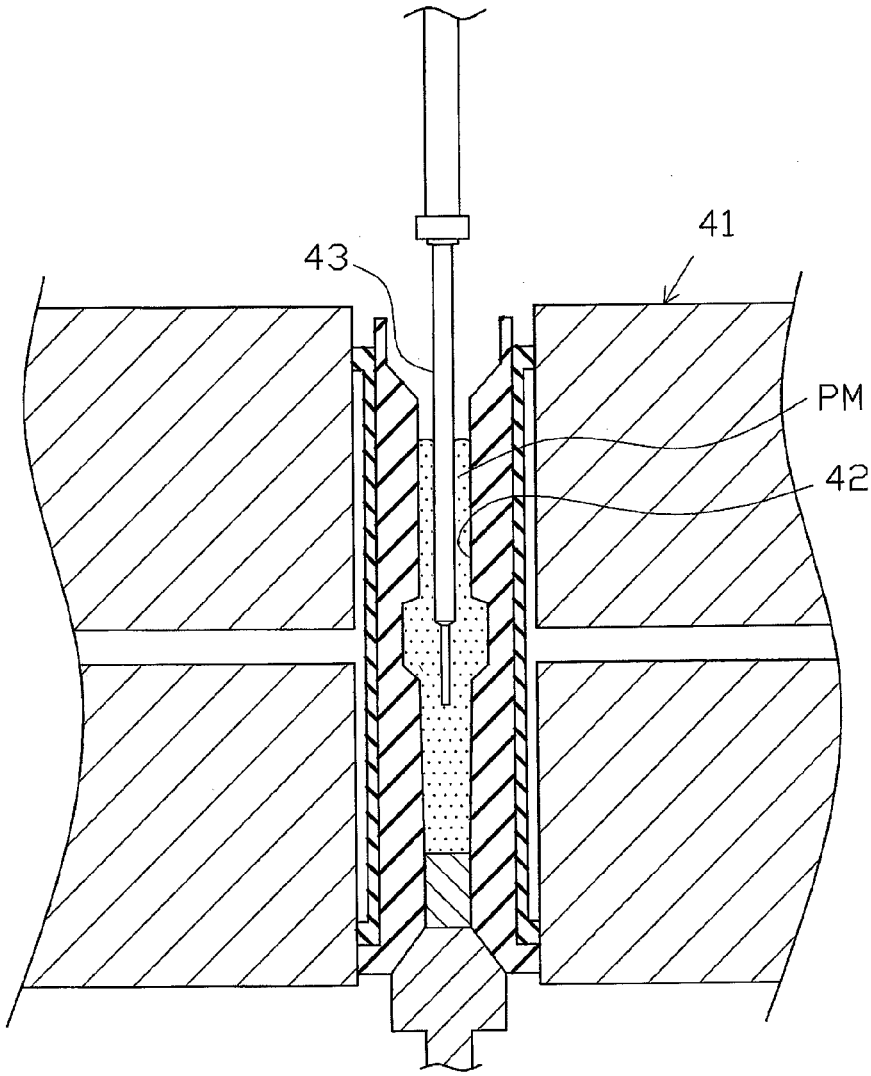
FIG. 6 is a partially cutaway front view showing a step in a ceramic insulator manufacturing process.

Next, the ceramic insulator 2 is manufactured. First, as shown in FIG. 6, a material powder PM which contains alumina powder as a main component is charged into a cavity 42 of a predetermined rubber press forming machine 41, and a rodlike press pin 43 is inserted into the cavity 42. The press pin 43 has an outer circumferential shape which corresponds to the end-surface seat portion 32, the outer circumferential portion 33, the curved portion 35, etc.

Figure 7:
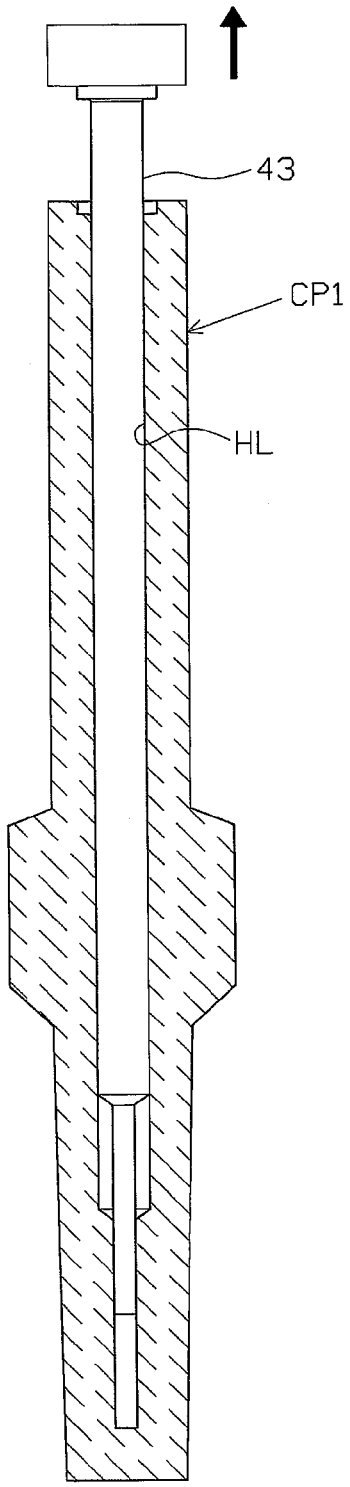
FIG. 7 is a partially cutaway front view showing the configuration of a green compact, etc.

After insertion of the press pin 43, an upper opening portion of the cavity 42 is closed so as to bring the cavity 42 into a sealed condition. Then, the rubber press forming machine 41 radially applies force to the material powder PM for compressing and forming the material powder PM. Next, as shown in FIG. 7, a green compact CP1 formed from the material powder PM by compressing and forming is removed from the rubber press forming machine 41, and the press pin 43 is removed from the green compact CP1. A hole HL of the green compact CP1 formed through removal of the press pin 43 is to become the axial bore 4.

Figure 8:
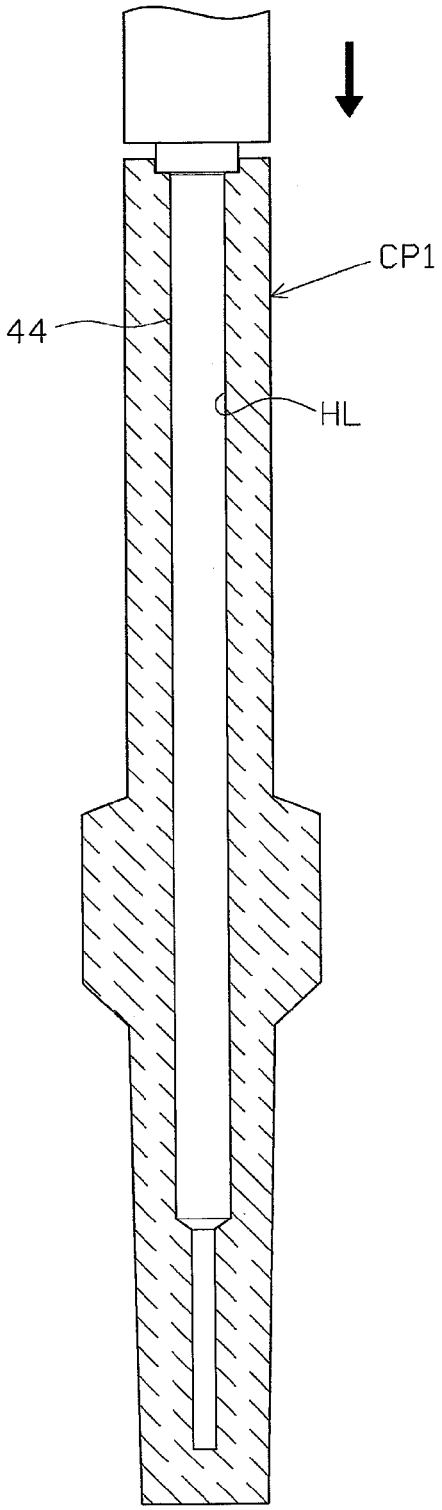
FIG. 8 is a partially cutaway front view showing a support pin inserted into the green compact, etc.

Next, as shown in FIG. 8, a rodlike support pin 44 is inserted into the hole HL of the obtained green compact CP1. As mentioned above, since that portion of the axial bore 4 which corresponds to the rear trunk portion 10 has an inside diameter of a certain value or greater, at least a portion of the support pin 44 on the proximal side has a relatively large outside diameter; particularly, a proximal end portion of the support pin 44 corresponding to the outer circumferential portion 33 has a very large outside diameter. Therefore, sufficient strength is imparted to that proximal end portion of the support pin 44 whose bending is particularly concerned in a grinding process to be mentioned later.

Figure 9:
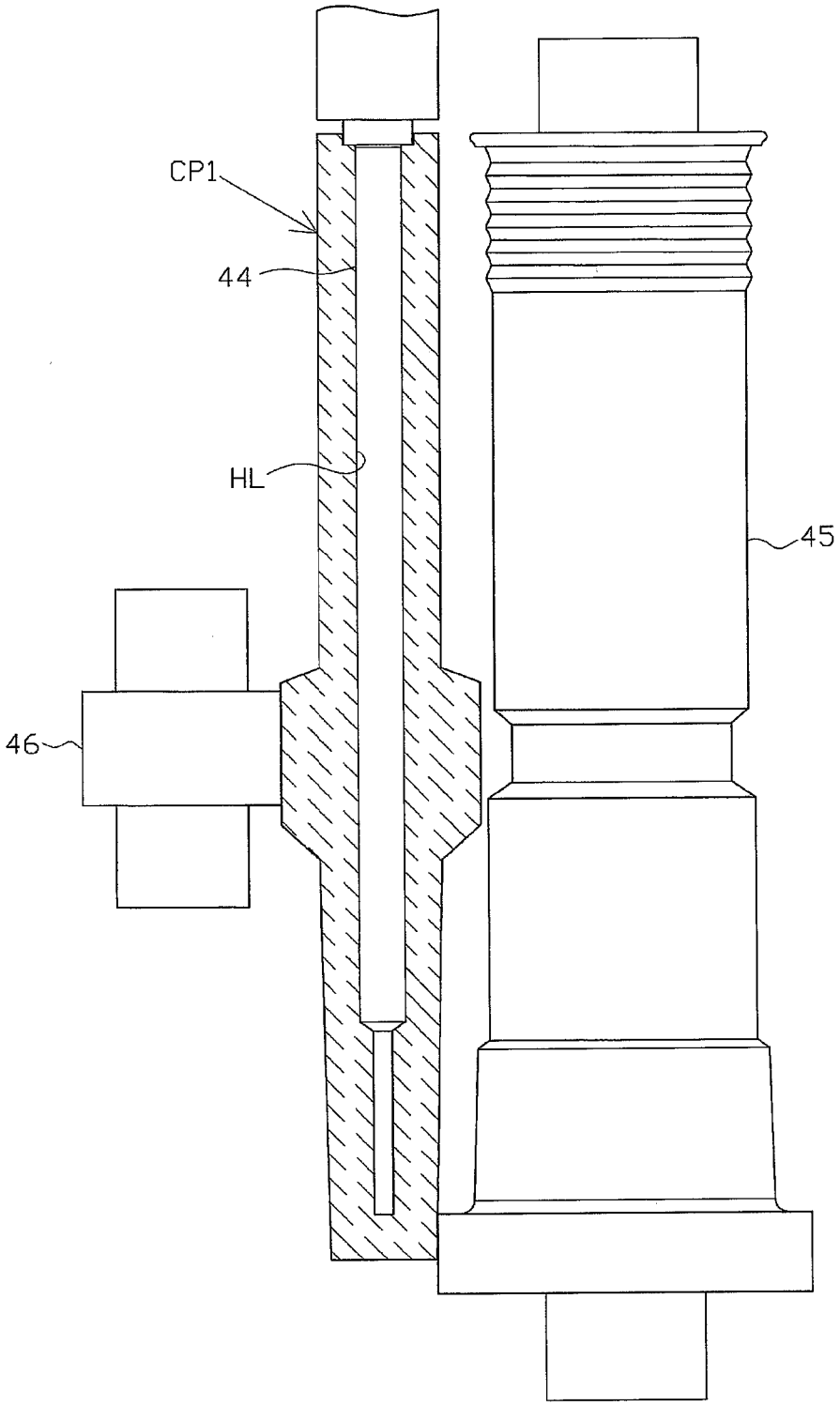
FIG. 9 is a partially cutaway front view showing a grinding process for the green compact.

As shown in FIG. 9, the green compact CP1 into which the support pin 44 is inserted is held between a grinding rotating roller 45 having an outer circumferential shape corresponding to the outer circumferential shape of the ceramic insulator 2, and a pressing member 46 which supports the green compact CP1 against friction force received from the grinding rotating roller 45. As a result of rotation of the grinding rotating roller 45, the green compact CP1 is subjected to the grinding process. The grinding process yields an insulator intermediate having the axial bore 4 formed of the hole HL extending therethrough and having substantially the same shape as that of the ceramic insulator 2. Subsequently, the obtained insulator intermediate is charged into a kiln and is formed into the ceramic insulator 2 through firing in the kiln.

Next, the ceramic insulator 2 and the center electrode 5, which are formed as mentioned above, the resistor 7, and the terminal electrode 6 are fixed in a sealed condition by means of the glass seal layers 8 and 9. More specifically, first, as shown in FIG. 10(*a*), the ceramic insulator 2 is supported by a predetermined support member (not shown); then, the center electrode 5 is inserted into the axial bore 4.

Figure 10:
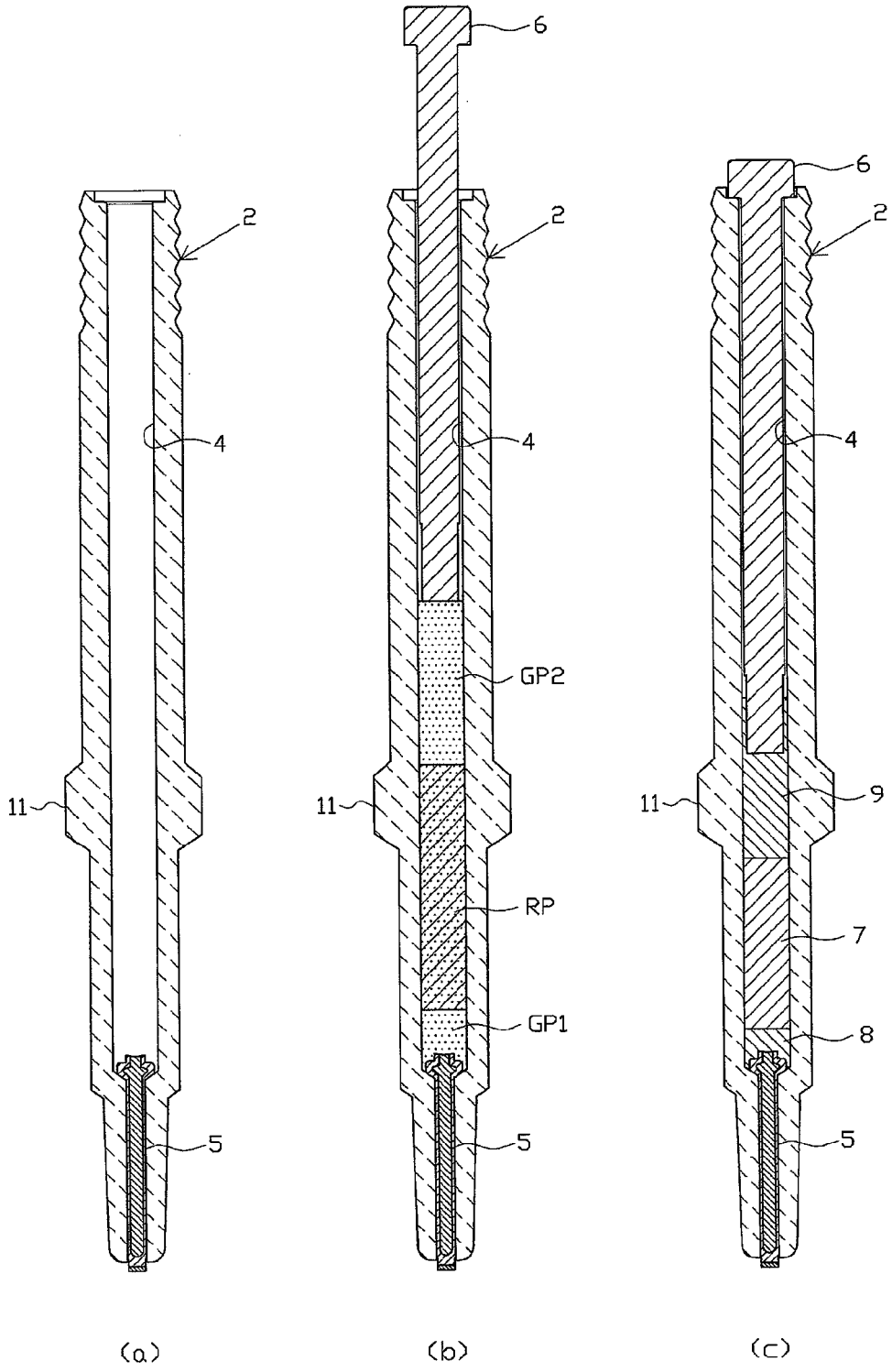
FIG. 10 is a set of sectional views consisting of views (a) to (c) and showing a process of fixing a terminal electrode, etc., to a ceramic insulator in a sealed condition.

Then, as shown in FIG. 10(*b*), an electrically conductive glass powder GP1 prepared by mixing borosilicate glass and a metal powder is charged into the axial bore 4, and the charged electrically conductive glass powder GP1 is preliminarily compressed. Next, a powdery resistor composition RP which contains an electrically conductive substance (e.g., carbon black) and ceramic particles is charged into the axial bore 4, followed by similar preliminary compression; furthermore, an electrically conductive glass powder GP2 is charged, followed by similar preliminary compression.

Next, the terminal electrode 6 is inserted into the axial bore 4. While the inserted terminal electrode 6 is pressed toward the center electrode 5, the resultant assembly is heated within a kiln at a predetermined target temperature (e.g., 900° C.) equal to or higher than the glass softening point. In inserting the terminal electrode 6 into the axial bore 4, by virtue of presence of the curved portion 35 formed on the inner circumference of the ceramic insulator 2, the terminal electrode 6 is easily inserted, and misalignment between the center axis of the terminal electrode 6 and the axis CL1 is restrained.

As a result of application of heat within the kiln, as shown in FIG. 10(*c*), the resistor composition RP and the electrically conductive glass powders GP1 and GP2 in a layered condition are heated and compressed to become the resistor 7 and the glass seal layers 8 and 9, respectively, and the glass seal layers 8 and 9 fix the center electrode 5, the terminal electrode 6, and the resistor 7 to the ceramic insulator 2 in a sealed condition. In application of heat within the kiln, a glaze layer may be simultaneously formed through firing on the surface of the rear trunk portion 10; alternatively, the glaze layer may be formed beforehand.

Subsequently, the ceramic insulator 2 having the center electrode 5, the resistor 7, etc., formed as mentioned above, and the metallic shell 3 having the ground electrode 27 are fixed together. More specifically, in a state in which the ceramic insulator 2 is inserted through the metallic shell 3, a relatively thin-walled rear-end opening portion of the metallic shell 3 is crimped radially inward; i.e., the above-mentioned crimped portion 20 is formed, thereby fixing the ceramic insulator 2 and the metallic shell 3 together.

Finally, the ground electrode 27 is bent, and the magnitude of the spark discharge gap 29 between the ground electrode 27 and a forward end portion (tip 28) of the center electrode 5 is adjusted, thereby yielding the above-mentioned ignition plug 1.

As described in detail above, according to the present embodiment, the insulator 2 has the outer circumferential portion 33 into which at least a forward end portion of the head portion 6B is inserted and which is located externally of the outer circumference of the head portion 6B. Therefore, when vibration is imposed on the ignition plug 1 as a result of vibration of an internal combustion engine or the like, the outer circumferential portion 33 restricts oscillation of the head portion 6B, which is relatively large in outside diameter and, in turn, large in weight and which is located most distant from a forward end portion of the terminal electrode 6. Accordingly, the amplitude of the head portion 6B becomes small, whereby energy generated by the head portion 6B can be reduced. By virtue of this, there can be reduced the force, derived from the energy generated by the head portion 6B, that the terminal electrode 6 (leg portion 6A) applies to the rear trunk portion 10. As a result, without need to increase the wall thickness of the rear trunk portion 10, there can be reliably prevented breakage of and deterioration in strength of the rear trunk portion 10 which could otherwise result from impact of the terminal electrode 6.

In the case of the present embodiment where the rear trunk portion 10 has a maximum outside diameter D of 9.5 mm or less; i.e., the rear trunk portion 10 is relatively thin-walled and where the length of the leg portion 6A along the axis CL1 is relatively large, at the time of vibration of the terminal electrode 6, energy generated at the head portion 6B is apt to become relatively large; however, employment of the configuration mentioned above can more reliably prevent breakage of the rear trunk portion 10 or a like problem.

Also, the present embodiment is configured such that the distance L1 is 0.5 mm or more and such that the relational expression L1/L2≥1/3 is satisfied. Therefore, the outer circumferential portion 33 can more reliably restrict oscillation of the head portion 6B, whereby breakage of the rear trunk portion 10 or a like problem can be further reliably prevented.

Additionally, even in the case where breakage of the rear trunk portion 10 or a like problem is of concern as a result of the length L2 of the head portion being 3.5 mm or less, through employment of a distance L1 of 0.8 mm or more, the outer circumferential portion 33 can further reliably restrict oscillation of the head portion 6B, so that breakage of the rear trunk portion 10 or a like problem can be very effectively prevented.

Furthermore, the curved portion 35 convexly curved toward the axis CL1 is provided between the leg-portion insertion portion 34 and the end-surface seat portion 32. Therefore, in inserting the terminal electrode 6 into the ceramic insulator 2, the curved portion 35 guides the leg portion 6A, so that the axis CL1 and the center axis of the terminal electrode 6 can accurately coincide with each other. Thus, the gap between the outer circumferential portion 33 and the head portion 6B can be substantially uniform along the circumferential direction. As a result, even when the terminal electrode 6 oscillates in any radial direction along the circumferential direction, the amplitude of the head portion 6B can be restrained within a relatively small range, whereby breakage of the rear trunk portion 10 or a like problem can be further reliably prevented. Also, since the gap between the leg-portion insertion portion 34 and the leg portion 6A can be substantially uniform along the circumferential direction, contact of the leg portion 6A with the rear trunk portion 10 can be restrained. Therefore, the effect of preventing breakage of the rear trunk portion 10 or a like problem can be further improved.

Additionally, since the width L3 of the end-surface seat portion 32 is 0.5 mm or more, the forward end surface of the head portion 6B can more reliably come into contact with the end-surface seat portion 32. As a result, positional deviation of the head portion 6B in the direction of the axis CL1 can be more reliably prevented.

Meanwhile, since the width L3 is 2.0 mm or less, a sufficient wall thickness can be ensured for the outer circumferential portion 33 located radially outward of the end-surface seat portion 32. Therefore, there can be effectively prevented chipping or a like defect of the outer circumferential portion 33 which could otherwise result from contact of the head portion 6B.

Also, in the present embodiment, in a section which contains the axis CL1, the outline of the end-surface seat portion 32 extends in a direction orthogonal to the axis CL1. Therefore, a situation in which the center axis of the terminal electrode 6 inclines with respect to the axis CL1 becomes unlikely to arise, so that the head portion 6B can be more properly positioned.

Furthermore, the distance L4 along the axis CL1 from the end-surface seat portion 32 to the bottom 31A of the groove portion 31 (to a particularly thin-walled portion of the rear trunk portion 10) is 0.5 mm or more. Therefore, stress which is generated at the root of the outer circumferential portion 33 as a result of contact of the head portion 6B with the outer circumferential portion 33 can be unlikely to be applied to the thin-walled portion. As a result, breakage of the thin-walled portion can be more reliably prevented.

Additionally, in the case where the outer circumferential portion 33 has the diameter-reducing portion 33A or 33B and in the case where the head portion 6B has the diameter-increasing portion 6E, in insertion of the terminal electrode 6 into the axial bore 4 or in a like operation, the center axis of the terminal electrode 6 can further accurately coincide with the axis CL1. By virtue of this, the gap between the outer circumferential surface of the terminal electrode 6 and the inner circumferential surface of the ceramic insulator 2 can be substantially uniform along the circumferential direction. Therefore, the amplitude of the head portion 6B can be restrained within a smaller range, and contact of the leg portion 6A with the rear trunk portion 10 can be restrained. As a result, the effect of preventing breakage of the rear trunk portion 10 or a like problem can be further improved.

Next, in order to verify actions and effects to be yielded by the above embodiment, there were manufactured ignition plugs having ceramic insulator samples which differed in the maximum outside diameter of the rear trunk portion, presence or absence of the outer circumferential portion, distance L1, length L2, width L3, presence or absence of the curved portion, and radius of curvature R1 of the curved portion. The prepared ignition plugs were subjected to a strength measurement test.

The strength measurement test is outlined below. The ignition plugs were subjected to the impact resistance test [in which a sample is mounted to a predetermined testing apparatus, and impact (vibration) is imposed on the sample 400 times per minute for 10 minutes] according to JIS B8031; then, pressure was applied to the rear trunk portions of the samples, and load under which the rear trunk portions cracked was measured as strength. In this connection, the following can be said: the greater the measured load (strength), the less likely a deterioration in strength of the ceramic insulator is to arise; i.e., the less likely the cracking or breakage of the ceramic insulator (rear trunk portion) is to arise.

There were manufactured a plurality of ceramic insulator samples which differed in the above-mentioned parameters such as the maximum outside diameter of the rear trunk portion. The samples were subjected to a positional-deviation check test. The positional-deviation check test is outlined below. After insertion of the terminal electrodes into the respective samples, the samples were checked for the position of the head portion relative to the rear end of each sample (ceramic insulator), and there was calculated a rate (positional deviation rate) at which the head portion was located outside a predetermined target range. The positional deviation rate was calculated for ignition plugs which did not have the outer circumferential portion and in which the forward end surface of the head portion was in contact with the rear end surface of the ceramic insulator, and the calculated positional deviation rate was taken as the reference positional deviation rate. When the calculated positional deviation rate was the reference positional deviation rate plus 10% or less, the sample was evaluated as "Good," indicating that, in the sample, the positional deviation of the terminal electrode along the axial direction was unlikely to arise. When the calculated positional deviation rate was the reference positional deviation rate plus 20% or more, the sample was evaluated as "Fair," indicating that, in the sample, the positional deviation of the terminal electrode along the axial direction was somewhat likely to arise.

Furthermore, a chipping check test was conducted on the ignition plugs having the ceramic insulators which differed in the parameters such as the maximum outside diameter of the rear trunk portion. The chipping check test is outlined below. The ignition plugs were subjected to the impact resistance test specified in JIS B8031 mentioned above. The rear end portions (outer circumferential portions, if provided) of the ceramic insulators were checked for presence or absence of chipping, and the incidence of chipping was calculated. The incidence of chipping after the impact resistance test was calculated for ignition plugs which did not have the outer circumferential portion and in which the forward end surface of the head portion was in contact with the rear end surface of the ceramic insulator, and the calculated incidence of chipping was taken as the reference incidence of chipping. When the calculated incidence of chipping was the reference incidence of chipping +5% or less, the sample was evaluated as "Good," indicating that, in the sample, chipping of the ceramic insulator was able to be sufficiently restrained. When the calculated incidence of chipping was the reference incidence of chipping +10% or more, the sample was evaluated as "Fair," indicating that, in the sample, chipping of the ceramic insulator was somewhat likely to occur.

Table 1 shows the results of the above-mentioned tests conducted on the samples. Samples A to D in Table 1 were configured such that the ceramic insulator did not have the outer circumferential portion, so that the ceramic insulator was not located externally of the outer circumference of the head portion. Samples 1 to 16 in Table 1 were configured such that the ceramic insulator had the outer circumferential portion, so that the outer circumferential portion was located externally of the outer circumference of the head portion.

Additionally, sample 15 was configured such that the outer circumferential portion had a diameter-reducing portion whose inside diameter reduced forward with respect to the axial direction, and sample 16 was configured such that the outer circumferential portion had the diameter-reducing portion and such that the head portion had a diameter-increasing portion whose outside diameter increases rearward with respect to the axial direction.

Also, the mark "-" in the "Radius of curvature R1" column indicates that the curved portion was not provided; i.e., the end-surface seat portion and the leg-portion insertion portion were substantially orthogonal to each other. Additionally, the head portions of the terminal electrodes had the same outside diameter, and the width L3 of the end-surface seat portion was changed through adjustment of the inside diameter of the leg-portion insertion portion.

TABLE 1

| | Max. dia. of rear trunk portion (mm) | Distance L1 (mm) | Length L2 (mm) | L1/L2 | Width L3 (mm) | Radius of curvature R1 (mm) | Strength after impact resistance test (kN) | Result of positional-deviation check test | Result of chipping check test |
|---|---|---|---|---|---|---|---|---|---|
| Sample A | 10.5 | 0.0 | 11.0 | — | — | — | 8.0 | Good | Good |
| Sample B | 10.0 | 0.0 | 11.0 | — | — | — | 6.5 | Good | Good |
| Sample C | 9.5 | 0.0 | 11.0 | — | — | — | 4.0 | Good | Good |
| Sample D | 9.5 | 0.0 | 3.5 | — | — | — | 3.7 | Good | Good |
| Sample 1 | 9.5 | 0.3 | 11.0 | 1/37 | 2.0 | — | 4.8 | Good | Good |
| Sample 2 | 9.5 | 0.3 | 3.5 | 3/35 | 2.0 | — | 4.5 | Good | Good |
| Sample 3 | 9.5 | 0.5 | 3.5 | 1/7 | 2.0 | — | 5.7 | Good | Good |
| Sample 4 | 9.5 | 0.8 | 3.5 | 2/9 | 2.0 | — | 6.0 | Good | Good |
| Sample 5 | 9.5 | 0.8 | 11.0 | 4/55 | 2.0 | — | 6.0 | Good | Good |
| Sample 6 | 9.5 | 1.0 | 3.5 | 2/7 | 2.0 | — | 6.3 | Good | Good |
| Sample 7 | 9.5 | 1.0 | 3.0 | 1/3 | 2.0 | — | 6.7 | Good | Good |
| Sample 8 | 9.5 | 1.0 | 3.0 | 1/3 | 2.0 | 0.05 | 6.7 | Good | Good |
| Sample 9 | 9.5 | 1.0 | 3.0 | 1/3 | 2.0 | 0.1 | 7.0 | Good | Good |
| Sample 10 | 9.5 | 1.0 | 3.0 | 1/3 | 2.0 | 0.5 | 7.0 | Good | Good |
| Sample 11 | 9.5 | 1.0 | 3.0 | 1/3 | 2.0 | 3.0 | 7.0 | Good | Good |
| Sample 12 | 9.5 | 1.0 | 3.0 | 1/3 | 0.3 | 0.5 | 7.0 | Fair | Good |
| Sample 13 | 9.5 | 1.0 | 3.0 | 1/3 | 0.5 | 0.5 | 7.0 | Good | Good |
| Sample 14 | 9.5 | 1.0 | 3.0 | 1/3 | 2.5 | 0.5 | 7.0 | Good | Fair |
| Sample 15 | 9.5 | 1.0 | 3.0 | 1/3 | 2.0 | 0.5 | 7.2 | Good | Good |
| Sample 16 | 9.5 | 1.0 | 3.0 | 1/3 | 2.0 | 0.5 | 7.5 | Good | Good |

As shown in Table 1, in samples A to D having no outer circumferential portion, in the case of an outside diameter of the rear trunk portion in excess of 9.5 mm (samples A and B), strength after the impact resistance test was in excess of 4 kN, so that deterioration in strength caused by vibration was unlikely to occur. In the case of an outside diameter of the rear trunk portion of 9.5 mm or less (samples C and D), strength after the impact resistance test was 4 kN or less, so that deterioration in strength of the rear trunk portion caused by vibration was quite likely to occur, indicating that breakage of the rear trunk portion or a like problem was particularly concerned.

By contrast, in the samples having the outer circumferential portion (samples 1 to 16), even though the outside diameter of the rear trunk portion is 9.5 mm or less, strength after the impact resistance test is 4.5 kN or greater, indicating that deterioration in strength caused by vibration is unlikely to arise. Conceivably, this is for the following reason: when vibration was imposed on the ignition plug, since the outer circumferential portion restricted oscillation of the head portion, the amplitude of the head portion reduced; as a result, the force applied to the rear trunk portion from the terminal electrode reduced, so that generation of fine cracking in the rear trunk portion caused by impact of the terminal electrode became unlikely to arise.

Furthermore, the samples having a distance L1 of 0.5 mm or more (samples 3 to 16) exhibit a strength after the impact resistance test far greater than 5 kN; i.e., it has been confirmed that strength after the impact resistance test is markedly improved. Conceivably, this is for the following reason: through employment of a distance L1 of 0.5 mm or more, the outer circumferential portion more reliably restricted oscillation of the head portion.

Also, comparison of strength after the impact resistance test among samples C and D and samples 1 and 2 has confirmed that as a result of employment of a length L2 of 3.5 mm or less, deterioration in strength of the rear trunk portion is more likely to arise; however, as is apparent from the test results of samples 4 and 5, even when the length L2 is 3.5 mm or less, through employment of a distance L1 of 0.8 mm or more, strength equivalent to that at a length L2 in excess of 3.5 mm can be maintained.

Additionally, the samples which satisfy the relational expression L1/L2≥1/3 (samples 7 to 16) have been found to exhibit further improved strength after the impact resistance test. Conceivably, this is for the following reason: the outer circumferential portion restricted vibration of that portion of the head portion which was located further rearward (portion located more distant from the vibratory fulcrum), whereby the amplitude of the head portion was further reduced.

Furthermore, among the samples having the curved portion (samples 8 to 16), those having a radius of curvature R1 of the curved portion of 0.1 mm or more (samples 9 to 16) have been found to exhibit further improved strength after the impact resistance test. Conceivably, this is for the following reason: in insertion of the terminal electrode into the ceramic insulator, the curved portion guided the leg portion, whereby the axis and the center axis of the terminal electrode accurately coincided with each other.

Also, the samples having a width L3 of the end-surface seat portion of 0.5 mm or more (samples 1 to 11 and 13 to 16) have been found that the positional deviation of the terminal electrode along the axial direction is unlikely to arise. Conceivably, this is for the following reason: as a result of the end-surface seat portion having sufficiently large area, the forward end surface of the head portion more reliably came into contact with the end-surface seat portion, whereby there was able to be prevented the situation in which a portion of the forward end surface failed to come into contact with the end-surface seat portion, resulting in forward penetration of the head portion beyond the end-surface seat portion.

Furthermore, employment of a width L3 of 2.0 mm or less has been found to be able to restrain chipping of the ceramic insulator (particularly, the outer circumferential portion). Conceivably, this is for the following reason: through restraint of excessive width L3, the thickness of the outer circumferential portion was sufficiently ensured.

Additionally, the sample in which the outer circumferential portion has the diameter-reducing portion (sample 15) has been found to exhibit further improved strength after the impact resistance test. Conceivably, this is for the following reason: through contact of the head portion of the terminal electrode with the diameter-reducing portion, the axis and the center axis of the terminal electrode were able to accurately coincide with each other, and, in turn, the gap between the outer circumferential surface of the terminal electrode and the inner circumferential surface of the ceramic insulator became substantially uniform along the circumferential direction.

Also, the sample in which the head portion has the diameter-increasing portion (sample 16) has been found to further effectively restrain deterioration in strength of the rear trunk portion. Conceivably, this is for the following reason: the axis and the center axis of the terminal electrode were able to further accurately coincide with each other.

From the test results mentioned above, preferably, in an ignition plug in which breakage of and deterioration in strength of the rear trunk portion caused by vibration are particularly concerned as a result of employment of a maximum outside diameter of the rear trunk portion of 9.5 mm or less, in order to reliably prevent breakage of the rear trunk portion or a like problem, the outer circumferential portion is provided externally of the outer circumference of the head portion.

Also, in order to further effectively prevent breakage of the rear trunk portion or a like problem, more preferably, the distance L1 is 0.5 mm or more; the relational expression L1/L2≥1/3 is satisfied; and the curved portion is provided between the leg-portion insertion portion and the end-surface seat portion, and the curved portion has a radius of curvature R1 of 0.1 mm or more.

Additionally, more preferably, in an ignition plug in which deterioration in strength of the rear trunk portion or a like problem is of further concern as a result of employment of a length L2 of 3.5 mm or more, in order to effectively prevent deterioration in strength of the rear trunk portion or a like problem, the distance L1 is 0.8 mm or more.

Furthermore, far more preferably, in order to further reliably prevent breakage of the rear trunk portion or a like problem, the outer circumferential portion has the diameter-reducing portion and/or the head portion has the diameter-increasing portion.

Additionally, in view of restraint of positional deviation of the terminal electrode along the axial direction, preferably, the width L3 of the end-surface seat portion is 0.5 mm or more. In contrast, in order to prevent chipping of the outer circumferential surface, preferably, the width L3 of the end-surface seat portion is 2.0 mm or less.

Next, a flashover voltage measurement test and the above-mentioned strength measurement test were conducted on an ignition plug sample (sample 21) in which the outer circumferential surface of the rear trunk portion extended in parallel with the axis without provision of the groove portions at the rear trunk portion, and on ignition plug samples (samples 22 to 28) in which the rear trunk portion had a plurality of the groove portions and which differed in the distance L4 (mm) along the axis from the end-surface seat portion to the bottom of the groove portion, while the axially forward side with respect to the end-surface seat portion was taken as plus and the axially rear side as minus.

The flashover voltage measurement test is outlined below. In a state in which no discharge was generated across the spark discharge gap (e.g., in a state in which the ground electrode is removed, or a distal end portion of the ground electrode and a forward end portion of the center electrode are immersed in an electrically insulating oil), voltage applied to the head portion was gradually increased, and there was measured voltage (flashover voltage) at which abnormal discharge (flashover) between the head portion and the metallic shell along the outer circumferential surface of the rear trunk portion occurred. In view of reliable generation of normal spark discharges while demand for increase in voltage is met, the higher the flashover voltage, the more preferable. Table 2 shows flashover voltages of the samples and the results of the strength measurement test.

TABLE 2

| | Max. outside dia. of rear trunk portion (mm) | Groove portion presence or absence | Distance L4 (mm) | Flashover voltage (kV) | Strength after impact resistance test (kN) |
|---|---|---|---|---|---|
| Sample 21 | 9.5 | Absent | — | 35 | 6.0 |
| Sample 22 | 9.5 | Present | 2.0 | 38 | 6.0 |
| Sample 23 | 9.5 | Present | 0.7 | 38 | 5.9 |
| Sample 24 | 9.5 | Present | 0.5 | 38 | 5.8 |
| Sample 25 | 9.5 | Present | 0.2 | 38 | 5.2 |
| Sample 26 | 9.5 | Present | −0.3 | 38 | 5.0 |
| Sample 27 | 9.5 | Present | −0.8 | 38 | 5.7 |
| Sample 28 | 9.5 | Present | −1.5 | 38 | 5.8 |

As is apparent from Table 2, as compared with the sample (sample 21) in which the groove portions are not provided, the samples (samples 22 to 28) in which the groove portions are provided are increased in flashover voltage, but are apt to somewhat deteriorate in strength of the rear trunk portion when the absolute value of the distance L4 is less than 0.5 mm. Conceivably, this is for the following reason: stress which was generated at the root of the outer circumferential portion as a result of contact of the head portion with the outer circumferential portion was apt to be applied to a relatively thin-walled portion (bottom of the groove portion) of the rear trunk portion.

By contrast, it has been confirmed that the samples having an absolute value of the distance L4 of 0.5 mm or more (samples 22 to 24, 27, and 28) exhibit effective restraint of deterioration in strength of the rear trunk portion caused by vibration.

From the test results mentioned above, in order to further reliably prevent breakage of the rear trunk portion or a like problem, in the case where the rear trunk portion has the groove portions, preferably, the distance L4 along the axis from the end-surface seat portion to the bottom of the groove portion is 0.5 mm or more.

The present invention is not limited to the above-described embodiment, but may be embodied, for example, as follows. Of course, applications and modifications other than those exemplified below are also possible.

(a) In the embodiment described above, the head portion 6B has an outside diameter which is substantially fixed along the direction of the axis CL1; however, the shape of the head portion 6B is not limited thereto. For example, the head portion 6B may be configured to have a collar portion protruding radially outward and provided on its outer circumference at the forward side and such that the forward end surface of the collar portion is in contact with the end-surface seat portion 32 of the ceramic insulator 2. In this case, in view of, for example, material cost and strength of the outer circumferential portion 33, preferably, the distance L1 from the rear end of the outer circumferential portion 33 to the end-surface seat portion 32 is equal to or less than the thickness of the collar portion along the direction of the axis CL1.

Figure 11:
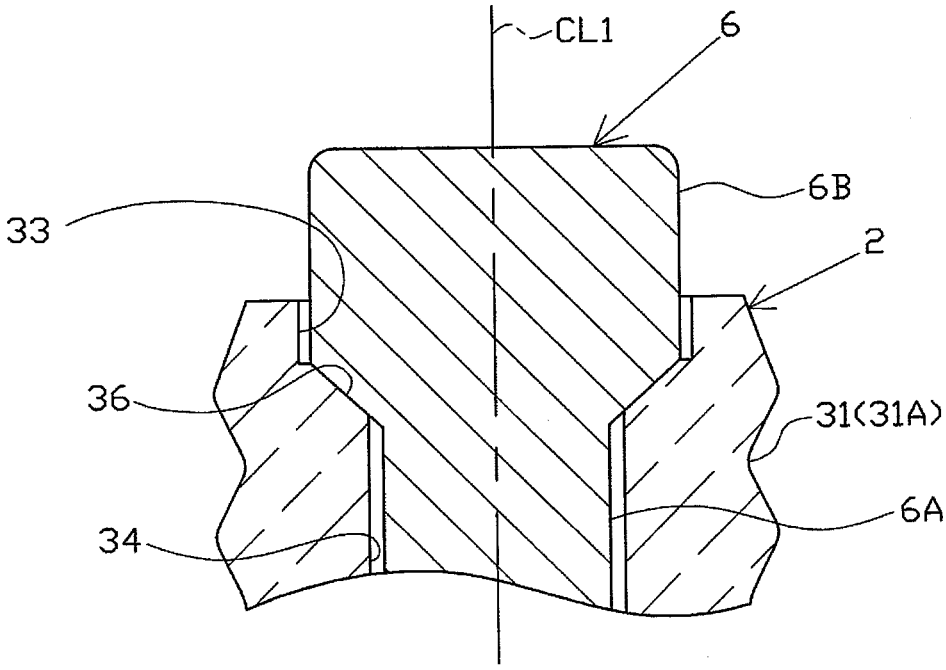
FIG. 11 is a enlarged sectional view showing the configuration of an end-surface seal portion in another embodiment.

(b) In the embodiment described above, the end-surface seat portion 32 is configured such that, in a section which contains the axis CL1, its outline extends in a direction orthogonal to the axis CL1. However, as shown in FIG. 11, an end-surface seat portion 36 may be configured such that, in a section which contains the axis CL1, its outline is inclined from a direction orthogonal to the axis CL1. In this case, the axis CL1 and the center axis of the terminal electrode 6 can be aligned with each other more accurately.

(c) In the embodiment described above, the ground electrode 27 is joined to the forward end portion 26 of the metallic shell 3. However, the present invention is applicable to the case where a portion of a metallic shell (or, a portion of an end metal piece welded beforehand to the metallic shell) is formed into a ground electrode by machining (refer to, for example, Japanese Patent Application Laid-Open (kokai) No. 2006-236906).

(d) In the embodiment described above, the tool engagement portion 19 has a hexagonal cross section. However, the shape of the tool engagement portion 19 is not limited thereto. For example, the tool engagement portion may have a Bi-HEX (modified dodecagonal) shape [IS022977:2005(E)] or the like.

DESCRIPTION OF REFERENCE NUMERALS

1: ignition plug
2: ceramic insulator (insulator)
3: metallic shell
4: axial bore
6: terminal electrode
6A: leg portion
6B: head portion
6E: diameter-increasing portion
10: rear trunk portion
31: groove portion
31A: bottom
32: end-surface seat portion
33: outer circumferential portion
33A, 33B, 33C: diameter-reducing portion
34: leg-portion insertion portion
35: curved portion
CL1: axis

The invention claimed is:

1. An ignition plug comprising:

an insulator having an axial bore extending in a direction of an axis;

a metallic shell disposed externally of an outer circumference of the insulator;

a terminal electrode having a leg portion inserted into a rear side of the axial bore, and a head portion formed on a rear side of the leg portion and having an outside diameter greater than that of the leg portion; and a rear trunk portion that is exposed from a rear end of the metallic shell and is provided in the insulator, said rear trunk portion having a maximum outside diameter of 9.5 mm or less, wherein the insulator has an end-surface seat portion located forward of a rear end of the insulator with respect to the direction of the axis and being in contact with a forward end surface of the head portion, and an outer circumferential portion into which at least a forward end portion of the head portion is inserted and which is located externally of an outer circumference of the head portion, wherein the insulator has a leg-portion insertion portion into which the leg portion is inserted and has a curved portion convexly curved toward the axis and formed between the leg-portion insertion portion and the end of the end-surface seat portion, and the end-surface seat portion is flat and extends along a direction orthogonal to the axis.

2. The ignition plug according to claim 1, wherein a relational expression L1≥0.5 is satisfied, where L1 (mm) is a distance along the axis from a rear end of the outer circumferential portion to the end-surface seat portion.

3. The ignition plug according to claim 1, wherein a relational expression L1/L2≥1/3 is satisfied, where L1 (mm) is a distance along the axis from a rear end of the outer circumferential portion to the end-surface seat portion, and L2 (mm) is a length of the head portion along the axis.

4. An ignition plug comprising:

an insulator having an axial bore extending in a direction of an axis;

a metallic shell disposed externally of an outer circumference of the insulator;

a terminal electrode having a leg portion inserted into a rear side of the axial bore, and a head portion formed on a rear side of the leg portion and having an outside diameter greater than that of the leg portion; and a rear trunk portion that is exposed from a rear end of the metallic shell and is provided in the insulator, said rear trunk portion having a maximum outside diameter of 9.5 mm or less, wherein the insulator has an end-surface seat portion located forward of a rear end of the insulator with respect to the direction of the axis and being in contact with a forward end surface of the head portion, and an outer circumferential portion into which at least a forward end portion of the head portion is inserted and which is located externally of an outer circumference of the head portion, wherein relational expressions L2≤3.5 and L1≥0.8 are satisfied, where L1 (mm) is a distance along the axis from a rear end of the outer circumferential portion to the end-surface seat portion, and L2 (mm) is a length of the head portion along the axis.

5. The ignition plug according to claim 1, wherein a relational expression R1≥0.1 is satisfied, where R1 (mm) is a radius of curvature of an outline of the curved portion in a section which contains the axis.

6. The ignition plug according to claim 1, wherein a relational expression 0.5≤L3≤2.0 is satisfied, where L3 (mm) is a width of the end-surface seat portion along a direction orthogonal to the axis.

7. The ignition plug according to claim 1, wherein a shortest distance along a direction orthogonal to the axis between an inner circumferential surface of the outer circumferential portion and an outer circumferential surface of that portion of the head portion which is inserted into the outer circumferential portion is smaller than a shortest distance along the direction orthogonal to the axis between an outer circumferential surface of the leg portion and an inner circumferential surface of the axial bore.

8. The ignition plug according to claim 1, wherein the outer circumferential portion has a diameter-reducing portion whose inside diameter reduces forward with respect to the direction of the axis.

9. The ignition plug according claim 1, wherein that portion of the head portion which is inserted into the outer circumferential portion has a diameter-increasing portion whose outside diameter increases rearward with respect to the direction of the axis.

10. An ignition plug comprising:

an insulator having an axial bore extending in a direction of an axis;

a metallic shell disposed externally of an outer circumference of the insulator;

a terminal electrode having a leg portion inserted into a rear side of the axial bore, and a head portion formed on a rear side of the leg portion and having an outside diameter greater than that of the leg portion; and a rear trunk portion that is exposed from a rear end of the metallic shell and is provided in the insulator, said rear trunk portion having a maximum outside diameter of 9.5 mm or less, wherein the insulator has an end-surface seat portion located forward of a rear end of the insulator with respect to the direction of the axis and being in contact with a forward end surface of the head portion, and an outer circumferential portion into which at least a forward end portion of the head portion is inserted and which is located externally of an outer circumference of the head portion, wherein the rear trunk portion has an annular groove portion formed on its outer circumference and extending along its circumferential direction, and a relational expression $L4 \geq 0.5$ is satisfied, where L4 (mm) is a distance along the axis from the end-surface seat portion to a bottom of the groove portion.

11. The ignition plug according to claim 1, wherein a gap between the outer circumferential portion and the head portion is substantially uniform along the circumferential direction.

* * * * *